US006470164B1

(12) United States Patent
Fukuyama

(10) Patent No.: US 6,470,164 B1
(45) Date of Patent: Oct. 22, 2002

(54) IMAGE FORMING APPARATUS PROVIDED WITH A DEVELOPMENT DEVICE HAVING A DISCHARGE PORT FOR A DEVELOPING SOLUTION

(75) Inventor: Hirotaka Fukuyama, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/922,706

(22) Filed: Aug. 7, 2001

(51) Int. Cl.[7] ..... G03G 15/01; G03G 15/08
(52) U.S. Cl. ..... 399/257; 399/299; 399/358
(58) Field of Search ..... 399/257, 252, 399/358, 299, 112, 113

(56) References Cited

U.S. PATENT DOCUMENTS 5,260,747 A * 11/1993 Uwagawa et al. ..... 399/257
5,937,252 A * 8/1999 Peters, Jr. et al. ..... 399/257 X
6,212,344 B1 * 4/2001 Takagi et al. ..... 399/112

FOREIGN PATENT DOCUMENTS

JP 2-21591 5/1990
JP 11-065194 * 3/1999

* cited by examiner

*Primary Examiner*—Sophia S. Chen
(74) *Attorney, Agent, or Firm*—Foley & Lardner

(57) ABSTRACT

An image forming apparatus includes a plurality of optical laser systems for forming electrostatic latent images on a plurality of photosensitive drums, a plurality of development devices for supplying developing solutions to the respective electrostatic latent images on the drums, a transfer belt for transporting paper to each of the drums and transferring the developed images on the drums onto the paper, cleanser for removing the solution remaining on the drums after the transfer of the images by the transfer belt, collection mechanism arranged in the cleaners to transport and collect the removed developing solution, feeding mechanisms to feed the developing solutions to the development devices and a discharge port to discharge part of the developing solution so that the developing solution is made to fall into the cleaner located in the development device and the developing solution in the cleaner is transported and collected by a collection mechanism.

3 Claims, 3 Drawing Sheets

IMAGE FORMING APPARATUS PROVIDED WITH A DEVELOPMENT DEVICE HAVING A DISCHARGE PORT FOR A DEVELOPING SOLUTION

BACKGROUND OF THE INVENTION

This invention relates to an image forming apparatus that can typically find applications in a quadruple tandem color electrophotographic apparatus.

A quadruple tandem color electrophotographic apparatus comprises four processing units arrange at certain intervals. The four processing units are provided with respective photosensitive drums. Around each of the photosensitive drums, there are arranged an electric charger for electrically charging the surface of the photosensitive drum to a predetermined electric potential, an exposure device for forming an electrostatic latent image on the surface of the photosensitive drum, a development device for developing the electrostatic latent image, a transfer charger for transferring the toner image onto a sheet of printing paper and a cleaner for removing the toner remaining on the photosensitive drum. The development device of the processing units are adapted to feed toners of different colors.

The electrostatic latent image formed on each of the photosensitive drums of the processing units is developed to produce a toner image as developing solution is fed from the development device. The toner images formed on the photosensitive drums are then sequentially transferred onto the sheet of paper being transported in an overlapping fashion to produce a color picture.

The developing solution fed from the development device typically comprises two components, a non-magnetic toner and a magnetic carrier that are mixed with each other. The service life of the developing solution terminates when the density of the formed image falls and/or when the image becomes remarkably foggy. Normally, it is considered that the apparatus needs servicing when the service life of the developing solution ends and a service person is called in to check the apparatus and manually replace the developing solution.

However, it is not efficient that the developing solution is manually replaced by a service person.

Therefore, in recent years, some cartridges containing toner and adapted to feed the development device with toner are made to also contain a liquid carrier in a mixed state so that both the carrier and the toner may be supplied periodically to the apparatus. When supplying the carrier, the developing solution remaining in the development device is removed by an amount corresponding to the amount of the carrier that is newly supplied. With this arrangement, the developing solution in the development device is prevented from being degraded and the manual replacement of developing solution does not take longer than necessary.

However, conventionally, the use of a specifically designed developing solution removing mechanism is required, which makes the supply of developing solution still costly and the image forming apparatus bulky.

BRIEF SUMMARY OF THE INVENTION

In view of the above identified circumstances, it is therefore the object of the present invention to provide an image forming apparatus that is adapted to be supplied with developing solution without requiring a specific developing solution removing mechanism.

According to the invention, the above object is achieved by providing an image forming apparatus comprising:

a plurality of image carriers arranged in parallel at predetermined intervals;

a plurality of image forming means for forming respective images on the plurality of image carriers;

a plurality of development means for feeding 2-component type developing solution containing toner of respective different colors and carrier to the respective electrostatic latent images formed on the plurality of image forming means and developing the electrostatic latent images;

a transfer device for moving an image receiving member to the image carriers and transferring the developed images on the image carriers sequentially onto the image receiving member in an overlapping fashion to produce a color image;

a plurality of cleaners for removing the developing solution remaining on the respective image carriers after the transfer of the developed images;

collection mechanisms arranged respectively in the cleaners and adapted to transport and collect the removed developing solution;

a supply device for supplying the development devices with 2-component developing solution containing toner and carrier; and a discharge port arranged at least at one of the development devices and adapted to discharge part of the 2-component developing solution already contained in the apparatus at the time of supplying developing solution;

the developing solution discharged from the discharge port of the development device being let to fall and collected in the cleaner located at an upstream position of the development device along the moving direction of the image receiving member so as to make the developing solution in the cleaner to be collected and removed by the collection mechanism.

In another aspect of the invention, there is also provided an image forming apparatus comprising:

a plurality of image carriers arranged in parallel at predetermined intervals;

a plurality of image forming means for forming respective images on the plurality of image carriers;

a plurality of development means for feeding 2-component type developing solution containing toner of respective different colors and carrier to the respective electrostatic latent images formed on the plurality of image forming means and developing the electrostatic latent images;

a transfer device for moving an image receiving member to the image carriers and transferring the developed images on the image carriers sequentially onto the image receiving member in an overlapping fashion to produce a color image;

a plurality of cleaners for removing the developing solution remaining on the respective image carriers after the transfer of the developed images;

collection mechanisms arranged in the cleaner and adapted to transport and collect the removed developing solution;

a supply device for supplying the development means with 2-component developing solution containing toner and carrier; and a discharge port arranged at least at one of the development means and adapted to discharge part of the 2-component developing solution already contained in the apparatus at the time of supplying developing solution;

the developing solution discharged from the discharge port of the development device being let to fall and collected in the cleaner located at an upstream position of the development device along the moving direction of the image receiving member so as to make the developing solution in the cleaner to be collected and removed by the collection mechanism.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
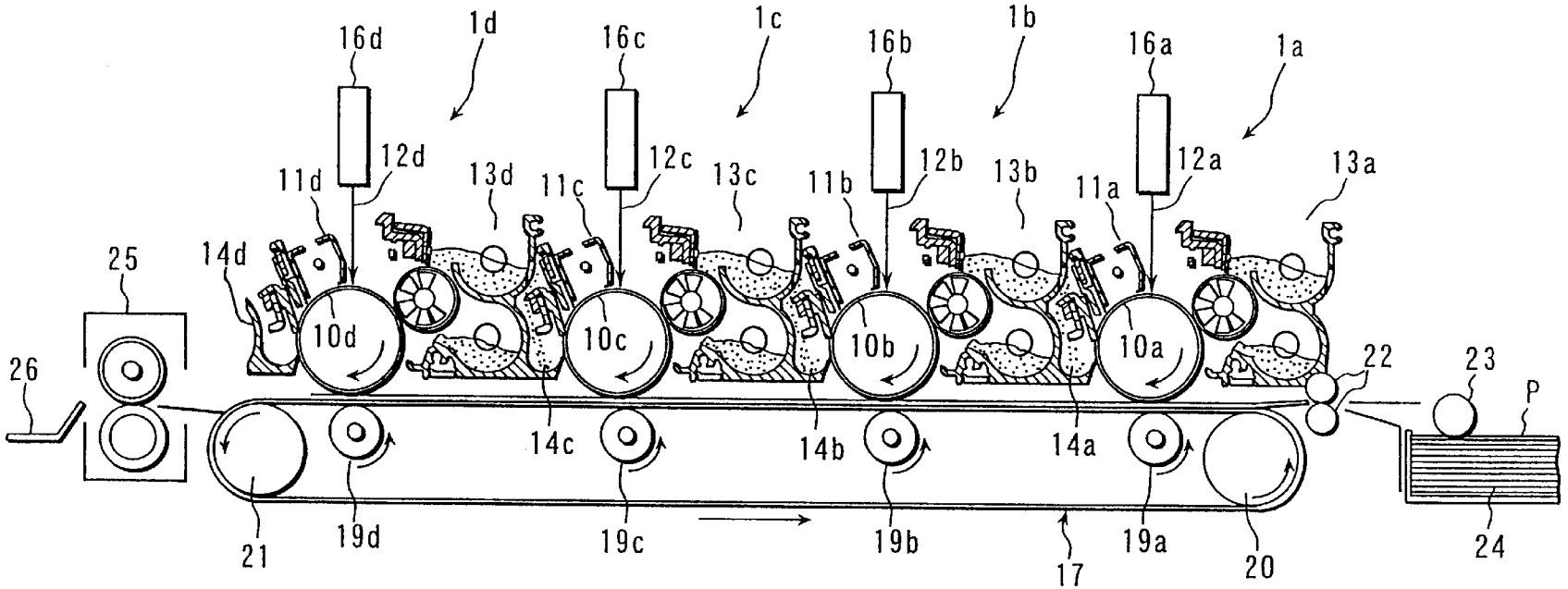
FIG. 1 is a schematic illustration of the internal arrangement of a color electrophotographic copying machine realized as an embodiment of the invention.

FIG. 1 is a schematic illustration of the internal arrangement of a color electrophotographic copying recording apparatus realized as an embodiment of the invention.

The color electrophotographic recording apparatus comprises first through fourth processing units 1*a* through 1*d* that are image forming devices of different colors. A transfer belt 17 for transporting sheets of paper P as image receiving members is arranged under the first through fourth processing units 1*a* through 1*d*. The transfer belt 17 is driven to move between a pair of retaining rollers 20, 21 in the direction indicated by arrow in FIG. 1. The first through fourth processing units 1*a* through 1*d* are arranged at predetermined intervals along the running direction of the transfer belt 17. The first through fourth processing units 1*a* through 1*d* are adapted to form respective toner images in yellow, magenta, cyan and black.

The processing units 1*a* through 1*d* comprise common components except the development device 13*a* of the most upstream processing unit 1*a* and the cleaner (developing solution removing means) 14*d* of the most downstream processing unit 1*d*.

The first through fourth processing units 1*a* through 1*d* comprise respective photosensitive drums 10*a* through 10*d*. The photosensitive drums 10*a* through 10*d* can revolve in the directions as indicated by respective arrows and are provided on the surface with a photosensitive layer. Additionally, electric chargers 11*a* through 11*d*, optical laser systems 16*a* through 16*d* for respectively irradiating laser beams 12*a* through 12*d*, first through fourth development devices 13*a* through 13*d*, cleaners 14*a* through 14*d* comprising respective blades and de-electrifying lamps (not shown) are arranged respectively around the outer peripheries of the first through fourth drums 10*a* through 10*d*.

Meanwhile, four electricity feeding rollers 19*a* through 19*d* are arranged inside the transfer belt 17 at positions corresponding to the respective processing units 1*a* through 1*d*, said electricity feeding rollers 19*a* through 19*d* constituting a transfer device with said transfer belt 17. The transfer belt 17 is held at the rear surface thereof in contact with the four electricity feeding rollers 19*a* through 19*d* and at the front surface thereof in contact with the four photosensitive drums 10*a* through 10*d*. The four electricity feeding rollers 19*a* through 19*d* rotate, following the running motion of the transfer belt 17. A transfer bias voltage is applied to the electricity feeding rollers 19*a* through 19*d* by a voltage supply source (not shown).

A paper feeding cassette 24 containing sheets of copying paper P as image receiving members is arranged on the upstream side of the transfer belt as viewed in the sense of feeding sheets of copying paper. The paper feeding cassette 24 is provided with a pickup roller 23 that rotates freely and is designed to pick up a sheet of paper P one at a time. A pair of register rollers 22 are provided at a position downstream relative to the pickup roller 23 so that the sheet of paper picked up by the pickup roller 23 moves toward the paired register rollers 22 that also rotate freely. The paired register rollers 22 are designed to forward the sheet of paper P with such timing that the front end of the sheet of paper P and those of the toner images formed on the photosensitive drums 10*a* through 10*d* may come into register. A heat roller type fixing device 25 and a delivery tray 26 are arranged at the downstream end of the transfer belt 17 where the sheet of paper P leaves the transfer belt 17.

Now, the image forming process of the above embodiment in a black printing mode will be described below.

In a black printing mode, the surface of the photosensitive drum 10*d* of the fourth processing unit 1*d* is uniformly electrically charged by the electric charger 11*d* typically to −500V. Then, as a laser beam 12*d* that is modulated by an image is irradiated onto the photosensitive drum 10*d* from the laser optical system 16*d* to form an electrostatic latent image on the surface of the photosensitive drum 10*d*. The electrostatic latent image is then reversed and developed by black toner that is electrically charged to show the negative polarity and fed from the development device 13*d* to produce a toner image on the surface of the photosensitive drum 10*d*. The toner image formed on the surface of the photosensitive drum 10*d* is then brought into contact with the sheet of paper P carried by the transferred belt 17 at the transfer section. At this time, a bias voltage is applied to the electricity feeding roller 19*d* and another voltage showing the polarity opposite to that of the toner image, typically +1,100V, is applied to the transfer belt 10*d* from the electricity feeding roller 19*d* to transfer the toner image onto the sheet of paper P. The sheet of paper P carrying the toner image transferred thereto is then sent from the transfer belt 17 to the fixing device 25, where it is heated and pressure is applied thereto until the toner image is fixed on the sheet of paper P. After the fixation, the sheet of paper P is discharged to the delivery tray 26. The toner remaining on the photosensitive drum 10*d* after the transfer of the toner image is removed by the cleaner 14*d* and collected and then the photosensitive drum 10*d* is de-electrified by a de-electrifying lamp (not shown) and made ready for forming the next image.

Now, the image forming process of the above embodiment in a color printing mode will be described below.

In a color printing mode, the surfaces of the four photosensitive drums 10*a* through 10*d* are uniformly electrically charged typically to −500V by the respectively electric chargers 11*a* through 11*d*. Then, electrostatic latent images are formed respectively on the photosensitive drums 10*a* through 10*d* as laser beams 12*a* through 12*d* are irradiated onto the photosensitive drums 10*a* through 10*d* from the laser optical systems 16*a* through 16*d*. Then, toners of the respective colors showing the negative polarity are fed to the electrostatic latent images from the development devices 13*a* through 13*d* to reverse and develop the electrostatic latent images into respective toner images. Then, the toner images on the photosensitive drums 10*a* through 10*d* are sequentially transferred onto the sheet of paper P carried and transported by the transfer belt 17 in an overlapping fashion. The sheet of paper P carrying the toner images transferred thereto in an overlapping fashion is then sent from the transfer belt 17 to the fixing device 25, where it is heated and pressure is applied thereto until the toner images are fixed on the sheet of paper P. The toner remaining on the photosensitive drums 10*a* through 10*d* after the transfer of the toner images is removed by the cleaners 14*a* through 14*d* and collected and then the photosensitive drums 10*a* through 10*d* are de-electrified by respective de-electrifying lamps (not shown) and made ready for forming the next images.

Figure 2:
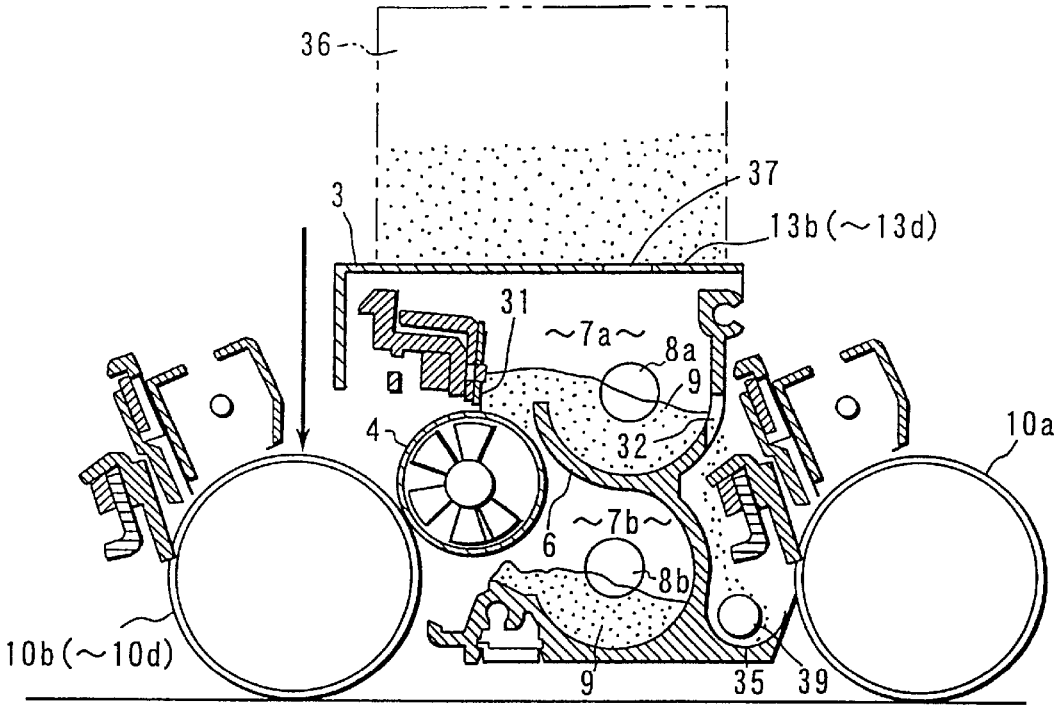
FIG. 2 is a schematic illustration of the development devices of the embodiment of FIG. 1.

FIG. 2 is a schematic illustration of the second through fourth development devices 13*b* through 13*d*.

Each of the second through fourth development devices 13*b* through 13*d* comprises a development casing 3. A development roller 4 is rotatively arranged in the development casing vis-a-vis the corresponding one of the photosensitive drums 10*b* through 10*d* at the front end side thereof. The rear end of the inside of the development casing 3 is partitioned by partitioning member 6 to produce upper and lower chambers 7*a*, 7*b*. Upper and lower mixers 8*a*, 8*b* are arranged respectively in the upper and lower chambers 7*a*, 7*b* as transportation mechanisms. At the same time the upper and lower chambers 7*a*, 7*b* contain 2-component developing solution 9 containing a non-magnetic toner and a magnetic carrier. A surgical blade 31 for forming a toner layer on the development roller 4 to a predetermined thickness is arranged above the development roller 4. The upper chamber 7*a* in the development casing 3 is provided at the rear side thereof with a discharge port 32 for discharging developing solution 9.

Figure 3:
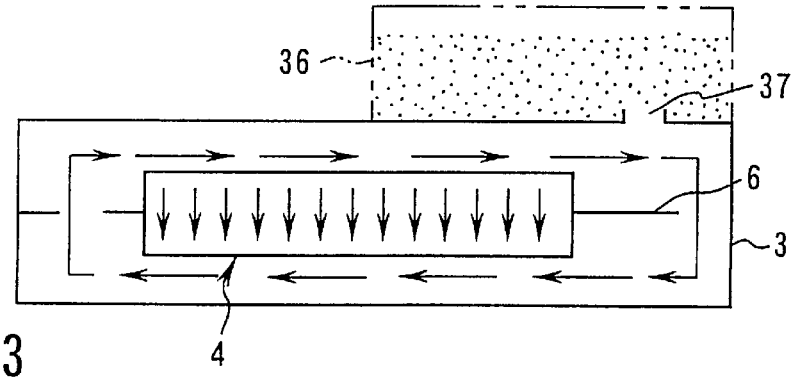
FIG. 3 is a schematic illustration of the flow of developing solution in the development devices of FIG. 2.
Figure 4:
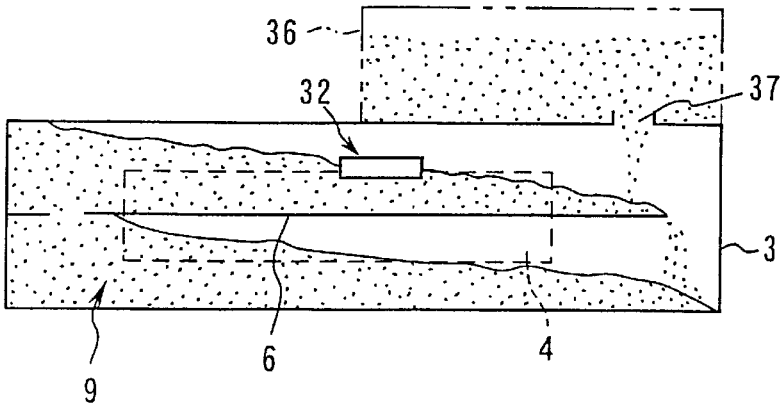
FIG. 4 is another schematic illustration of the flow of developing solution in the development devices of FIG. 2.

As shown in FIG. 3, the upper and lower mixers 8*a*, 8*b* are designed to circulate and move developing solution. As shown in FIG. 4, the upper mixer 8*a* is adapted to make developing solution 9 slope down in the right moving direction, while the lower mixer 8*b* is adapted to make developing solution 9 slope up in the moving direction.

When developing solution 9 is supplied at a rate exceeding a predetermined level, it is partly discharged through the port 32 to the outside from the development casing 3 in a manner as described hereinafter.

Each of the first through third cleaners 14*a* through 14*c* are provided with a cleaner casing 35. The cleaner casings 35 are provided in the inside with respective collection mechanisms 39 for moving and collecting waster toner. The development casings 3 of the second through fourth development devices 13*b* through 13*d* and the cleaner casings 35 of the processing units located upstream relative to the development casings 3 in the sense of the moving direction of sheets of paper are integrally formed.

On the other hand, each development casing 3 is provided on the top surface thereof with a developing solution feeding device 36. The feeding device 36 and the development casing 3 communicate with each other by way of a developing solution supply port 37. Toner is contained in the feeding device 36 as consumable. Additionally, a predetermined amount of carrier is contained in the feeding device 36 and mixed with toner.

Since no processing unit is arranged upstream relative to the development casing 3 of the first development device 18*a*, the latter differs from the remaining development devices 13*b* through 13*d* in that it is not integrally formed with a cleaner nor has any discharge port 32, but is provided with a developing solution collecting mechanism exclusively designed for it. Otherwise, the first development device 13*a* is identical with the remaining development devices 13*b* through 13*d* in terms of structure.

Now, the developing operation of the embodiment will be described below.

In a developing operation, the development rollers 4 are driven to rotate and, at the same time, the upper and lower mixers 8*a*, 8*b* are also driven to rotate. As the development rollers 4 rotate, developing solution 9 is fed to the electrostatic latent images on the photosensitive drums 10*a* through 10*d* to develop the electrostatic latent images. Additionally, as the upper and lower mixers 8*a*, 8*b* rotate, developing solution 9 is made to circulate to become transported in the direction indicated by arrow in FIG. 3. More specifically, in each of the development devices, developing solution 9 is transported by the rotating upper mixer 8*a* to the development roller 4 and the developing solution on the development roller 4 is peeled off from the latter by the rotation of the lower mixer 8*b* so that the developing solution is collected and removed.

Now, the operation of supplying developing solution to the second through fourth development devices 13*b* through 13*d* will be described below.

As toner is consumed by the development operation, toner and carrier are supplied to the development devices 13*b* through 13*d* from the developing solution feeding device 36. When the supplied developing solution exceeds a certain level, the excessive developing solution 9 is discharged to the outside through the discharge port 32 at the rear side of each of the development casings 3. The discharged developing solution 9 is then made to fall and collected by the cleaner casing 35 of the upstream processing unit. The developing solution 9 collected in the cleaner casing 35 is transported by the waste toner collection mechanism 39 and put into a collection box (not shown).

As developing solution is supplied to the first development device 18*a*, part of the existing toner is discharged from the first development device 13*a* and collected by a dedicated collection mechanism.

Figure 5:
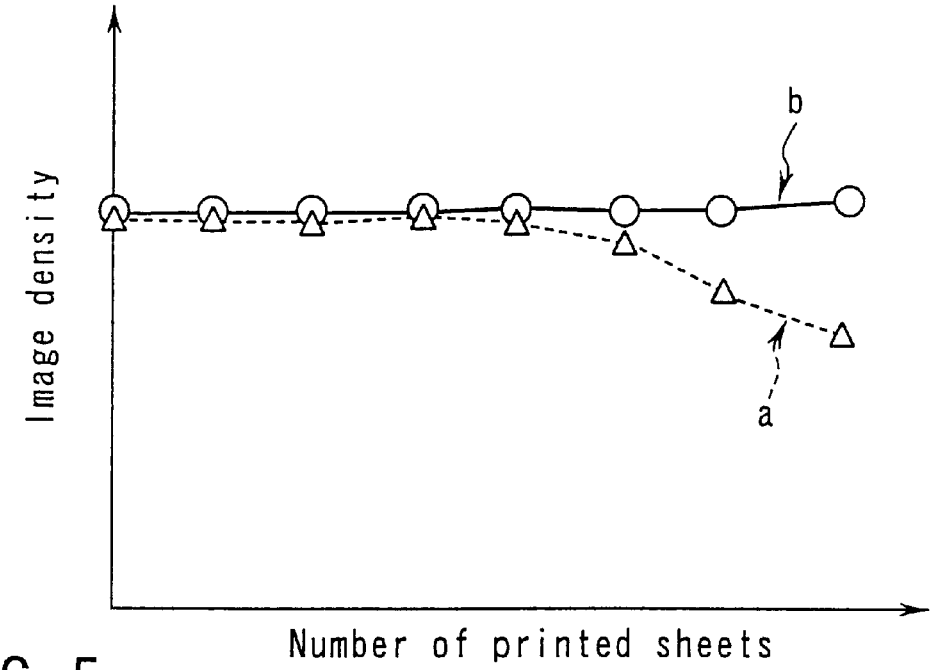
FIG. 5 is a graph illustrating the relationship between the number of printed sheets of paper and the image density.
Figure 6:
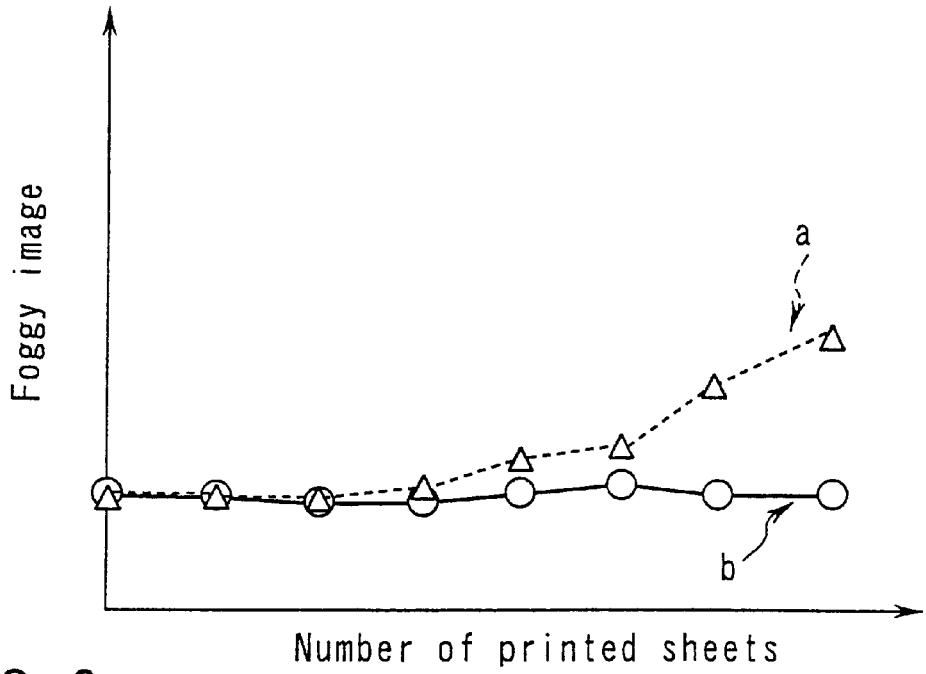
FIG. 6 is a graph illustrating the relationship between the number of printed sheets of paper and the fogginess of the image.

FIG. 5 is a graph illustrating the relationship between the number of printed sheets of paper and the image density and FIG. 6 is a graph illustrating the relationship between the number of printed sheets of paper and the fog on the image.

When the developing solution in the development device is not replaced, the image density falls and the image becomes foggy as the number of printed sheets increases as indicated by lines a in FIGS. 5 and 6. To the contrary, the image density does not fall nor foggy images appear with the development device of an image forming apparatus according to the invention if the number of printed sheets increases as shown by lines b in FIGS. 5 and 6.

As described above, according to the invention, at the time of supplying 2-component developing solution containing a toner and a carrier, waste developing solution 9 is discharged from the development casing 3 and collected in a cleaner casing 35 of the processing unit located upstream relative to the development casing 3 and the waste developing solution contained in the cleaner casing 35 is transported and collected by the water toner collection mechanism 39.

Therefore, it is no longer necessary to provide a dedicated collection mechanism for transporting and collecting waste developing solution from the development casing 3 because it is also used to operate as the waste toner collection mechanism 39 of the cleaner to simplify the overall structure and reduce the cost and the size of the apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a plurality of image carriers arranged in parallel at predetermined intervals;

a plurality of image forming means for forming respective electrostatic latent images on said plurality of image carriers;

a plurality of development devices for feeding 2-component type developing solution containing toner of respective different colors and carrier to the respective electrostatic latent images formed on the plurality of image carriers and developing the electrostatic latent images;

a transfer device for moving an image receiving member to said image carriers and transferring said developed images on said image carriers sequentially onto said image receiving member in an overlapping fashion to produce a color image;

a plurality of cleaners for removing the developing solution remaining on the respective image carriers after the transfer of the developed images;

collection mechanisms arranged respectively in said cleaners and adapted to transport and collect the removed developing solution;

a supply device for supplying said development devices with 2-component developing solution containing toner and carrier; and a discharge port arranged at least at one of said development devices and adapted to discharge part of the 2-component developing solution already contained in the apparatus at the time of supplying developing solution;

the developing solution discharged from said discharge port of said development devices being let to fall and collected in said cleaner located at an upstream position of the development devices along the moving direction of said image receiving member so as to make the developing solution in the cleaner to be collected and removed by said collection mechanisms.

2. The image forming apparatus according to claim 1, wherein each of said development devices comprises a development casing, a development roller arranged in said development casing to feed developing solution to the respective electrostatic latent image on said image carrier, a partition member for partitioning said development casing into upper and lower chambers and upper and lower transport mechanisms arranged respectively in said upper and lower chambers partitioned by said partition member and adapted to circulate and transport developing solution between the upper and lower chambers and feeding it to said development roller.

3. The image forming apparatus according to claim 2, wherein each of said cleaners is provided with a cleaner casing for receiving the developing solution discharged from said discharge port and the cleaner casing is integrally formed with the corresponding development casing.

* * * * *